US009889578B2

(12) United States Patent
Sahala et al.

(10) Patent No.: US 9,889,578 B2
(45) Date of Patent: Feb. 13, 2018

(54) METHOD, APPARATUS AND HOLLOW CORE FORMING MEMBER FOR CASTING CONCRETE PRODUCTS BY SLIPFORM CASTING

(71) Applicant: Elematic Oyj, Akaa (FI)

(72) Inventors: Tarmo Sahala, Valkeakoski (FI); Lassi Järvinen, Valkeakoski (FI); Leena Raukola, Kangasala (FI)

(73) Assignee: Elematic Oyj, Akaa (FI)

( * ) Notice: Subject to any disclaimer, the term of this patent is extended or adjusted under 35 U.S.C. 154(b) by 584 days.

(21) Appl. No.: 14/321,184

(22) Filed: Jul. 1, 2014

(65) Prior Publication Data

US 2015/0008606 A1 Jan. 8, 2015

(30) Foreign Application Priority Data

Jul. 4, 2013 (FI) ..... 20135731

(51) Int. Cl.

| | |
|---|---|
| ***B28B 7/30*** | (2006.01) |
| ***B28B 3/22*** | (2006.01) |
| ***B28B 1/26*** | (2006.01) |
| ***B28B 7/02*** | (2006.01) |

(52) U.S. Cl.

CPC ..... *B28B 7/30* (2013.01); *B28B 1/26* (2013.01); *B28B 1/261* (2013.01); *B28B 3/228* (2013.01); *B28B 7/02* (2013.01)

(58) Field of Classification Search

CPC ..... B28B 7/30; B28B 1/261; B28B 3/228; B28B 1/26; B28B 7/02

USPC ..... 425/64; 249/180, 185

See application file for complete search history.

(56) References Cited

U.S. PATENT DOCUMENTS

| | | | | |
|---|---|---|---|---|
| 1,480,010 | A * | 1/1924 | Roberts | B28B 7/32 249/178 |
| 2,359,471 | A | 10/1944 | Ewing | |
| 3,951,376 | A * | 4/1976 | Berndt | B28B 7/22 249/146 |
| 4,131,670 | A | 12/1978 | Abate | |

(Continued)

FOREIGN PATENT DOCUMENTS

| | | | |
|---|---|---|---|
| CN | 12000065 | A | 11/1998 |
| CN | 201633105 | U | 11/2010 |

(Continued)

OTHER PUBLICATIONS

Sep. 12, 2016, Office Action issued for related Chinese application.

(Continued)

*Primary Examiner* — Robert B Davis
(74) *Attorney, Agent, or Firm* — Berggren Inc.

(57) ABSTRACT

A method for casting a hollow core concrete product with a substantially horizontal slipform casting process, where concrete mass is fed at least in one feeding stage through a limited cross-section (5, 6, 7) moving progressively along with the cast, and at least one core is formed in the concrete product to be cast with a core forming member (4), wherein the thickness of webs between the cores of the product to be cast are changed during the slipform casting process by changing the width of the at least one core forming member (4). The invention also relates to such an apparatus and a core forming member.

7 Claims, 2 Drawing Sheets

(56) References Cited

U.S. PATENT DOCUMENTS

| | | | | |
|---|---|---|---|---|
| 4,272,230 | A | 6/1981 | Abate | |
| 4,674,971 | A * | 6/1987 | Kankkunen | B28B 3/228 425/381 |
| 4,755,338 | A | 7/1988 | Harala | |
| 2003/0151153 | A1 * | 8/2003 | Jarvinen | B28B 1/084 264/33 |
| 2008/0111279 | A1 | 5/2008 | Jarvinen | |

FOREIGN PATENT DOCUMENTS

| | | |
|---|---|---|
| EP | 0152166 | 8/1985 |
| EP | 1843882 | 3/2006 |
| EP | 1775088 | 4/2007 |
| FR | 2291332 | 10/1975 |
| GB | 540823 | 10/1939 |
| GB | 798231 | 7/1958 |
| WO | 2006072664 | 7/2006 |

OTHER PUBLICATIONS

Finnish Search Report for Patent App. No. 20135731.
Chinese Office Action dated Apr. 6, 2016 in corresponding Chinese Patent Application No. 201410315667.0.
European Search Report for corresponding Application No. 14171914.6-1703 dated Oct. 11, 2014.

* cited by examiner

METHOD, APPARATUS AND HOLLOW CORE FORMING MEMBER FOR CASTING CONCRETE PRODUCTS BY SLIPFORM CASTING

This application claims benefit of the filing date of FI 20135731, filed 4 Jul. 2013, the contents of which are incorporated herein by reference for all purposes.

BACKGROUND

1. Field

The present disclosure relates to casting of prefabricated concrete products with a substantially horizontal slipform casting process, where the concrete mix is fed at least in one step though a limited cross-section moving progressively along with the cast.

2. Description of Related Art

Several different slipform casting methods and devices are known in the art. The two main slipform casting methods for casting concrete products are extruder and slipformer methods. In the extruder method concrete mix is fed in a single feeding stage from a concrete mass container to feed screws which feed screws extrude the concrete mix to a slipform casting mold defined by upper surface of a casting bed and side and top plates of a casting machine. When casting hollow core slabs, the feed screws are followed by core forming mandrels forming the cores in form of longitudinal voids in the concrete product to cast. The compacting of the concrete product to be cast is achieved by vibrating and/or leveling motion of the side and top plates, and the forming of the cores is secured by back-and-forth compacting motion of an entity formed of the feed screw and the attached core mandrel. The casting machine moves along the casting bed driven by reaction force from the feed screws extruding the concrete mass and optionally with an additional drive motor. The ready cast product remains on the casting bed as the casting progresses.

In the slipformer casting method concrete mix is fed in at least two feeding stages from a concrete mass container to a slipform casting mold. In the first feeding stage concrete mass is fed to a lower portion of the casting mold formed by a top surface of a casting bed and side plates of a casting machine. The first feed stage of concrete mix is followed by vibrating shoes and core forming mandrels that by vibrating the concrete mix compacts the cast concrete mix and form the final shape of the lower part of the concrete product to be cast. In the second feeding stage concrete mix is fed onto the end portions of the core forming mandrels and on the previously cast concrete mix for casting the upper portion of the product to be cast, after which the concrete mix is compacted with a vibrating plate defining the upper surface of the slipform casting mold and located at the rear part of the casting machine. The ready cast product remains on the casting bed as the casting progresses.

Slipform casting is generally used for casting long products with uniform cross-section, such as massive or hollow core slabs, which are cut to predefined lengths after the concrete is cured.

Patent publication EP 1 843 882 B1 discloses a slipform casting method and apparatus for casting concrete products with cores, where the thickness of the cast concrete product can be changed by changing the height of the core forming mandrel and the location of the top plate of the slipform casting mold during the casting process. The disclosed apparatus may also be used to cast products with different thicknesses.

In concrete hollow core slabs thickness of the webs between the cores is one of the main features defining a shear stress capacity for the slab, especially in the end areas of the slab, which end areas are generally used for providing support for the slab in buildings.

The thickness of the webs between the cores is thus dimensioned based on the maximum shear stresses affecting the end areas of the slab. These maximum shear stresses do not affect the central area of the slab, but since the core forming members forming the hollow cores and the webs in the slab cannot be changed in slipform casting machines during the casting process, the webs have uniform thickness throughout the cast slab. This causes increased weight and decreased load capacity, for example, for the slabs.

One known solution for increasing the strength of the end areas of a hollow core slab is to fill the ends of the cores with concrete mass after the slipform casting process and thus add concrete in the critical areas of the slab. This however increases the use of concrete mass and slows down the manufacturing process.

SUMMARY

In embodiments of the present invention the width of cores, and thus also thickness of the webs between the cores, is changed in a slipform casting process by changing the width of core forming member(s) during casting. This allows casting thicker webs in the end areas of hollow core slabs, which increases durability against shear stresses of these areas, and the middle area or portion of the slab may be cast with thinner webs, which decreases the weight of the slab and use of concrete mass in the casting process.

In embodiments of the present invention the height of the core forming member may advantageously also be changed during the slipform casting process. This allows the whole cross-section of the cores to be changed during the casting process to optimize the best cross-sectional area of the cores for each section of the slab to be cast.

Advantageously the width and/or height of the core forming member are changed only on part or portion of the length of the core forming member. This allows the upstream end of the core forming member to substantially maintain its height and width during the casting process and only the width and/or height of the downstream end of the core forming member is changed with suitable gradual increase or decrease of these dimensions along the length of the hollow core forming member, for example.

Alternatively a section or portion of the length of the core forming member is provided at the upstream end of the core forming member, which section has fixed unchangeable cross-section. This section advantageously provides a fixing point for fixing the width and/or height changeable section or portion of the core forming member to the casting machine.

The embodiments of the present invention are advantageously used in extruder-type casting methods and apparatuses, where concrete mass is fed through a slipform casting mold in form of a restricted cross-section progressing along the cast with at least one feed screw, and the core forming member is connected at the downstream end of the feed screw. In this extruder-type casting process concrete mass is advantageously fed through the slipform casting mold in only one feeding stage.

In embodiments of the present invention the casting distance the slipform casting process and apparatus has proceeded may be measured, and this measurement data may be used to control the changing of the width and/or height of the core forming member so that correct cross-section of the core may be cast in correct portions and sections along the hollow core slab. This may be done with an automatic control system of the slipform casting machine following and measuring the distance cast with the machine, and based on this measurement data and design data of the slab to be cast input in the automatic control system, the automatic control system changes the width and/or height of the core forming member(s) at determined points of the slipform casting process.

The changing of the width and height of the core forming member of the invention may be implemented with suitable electrical, pneumatic or hydraulic means, with suitable cylinders or other linear movement devices for example, located advantageously inside the core forming member. These means are advantageously used to move surface parts forming the outer surface of the core forming member, which surface parts there are at least two, preferably at least four, for changing the outer dimensions of the core forming member on at least part of the length of the core forming member.

The embodiments of the present invention also relate to a core forming member of a slipform casting machine for casting concrete hollow core products, which core forming member comprises at least two surface parts forming the outer surface on the length of the core forming member, and means for changing the distance between the at least two surface parts for changing the width of the core forming member.

The features defining a method according to embodiments of the present invention are more precisely presented as a method for casting a hollow core concrete product with a substantially horizontal slipform casting process, where concrete mass is fed at least in one feeding stage through a limited cross-section (5, 6, 7) moving progressively along with the cast, and at least one core is formed in the concrete product to be cast with a core forming member (4), characterized in that the thickness of webs between the cores of the product to be cast are changed during the slipform casting process by changing the width of the at least one core forming member (4).

The features defining an apparatus according to embodiments of the present invention are more precisely presented as an apparatus (1) for casting a hollow core concrete product with a substantially horizontal slipform casting process, the apparatus comprising a slipform mold (5, 6, 7) defining a limited cross-section for the product to be cast, means (2) for feeding concrete mix through the slipform mold at least in one feeding stage, and at least one core forming member (4), characterized in that the apparatus (1) comprises means (4*a*, 4*b*, 11) for changing the width of the at least one core forming member (4) during the slipform casting process.

The features defining a core forming member according to embodiments of the present invention are more precisely presented as core forming member (4) of a slipform casting machine (1) for casting concrete hollow core products, which core forming member comprises at least two surface parts (4*a*, 4*b*) forming the outer surface on the length of the core forming member, characterized in that the core forming member (4) comprises means (11) for changing the distance between the at least two surface parts (4*a*, 4*b*) for changing the width of the core forming member.

BRIEF DESCRIPTION OF DRAWINGS

Exemplifying embodiment of the invention and its advantages are explained in greater detail below in the sense of example and with reference to accompanying drawings, where.

DETAILED DESCRIPTION OF SPECIFIC EMBODIMENTS

Figure 1:
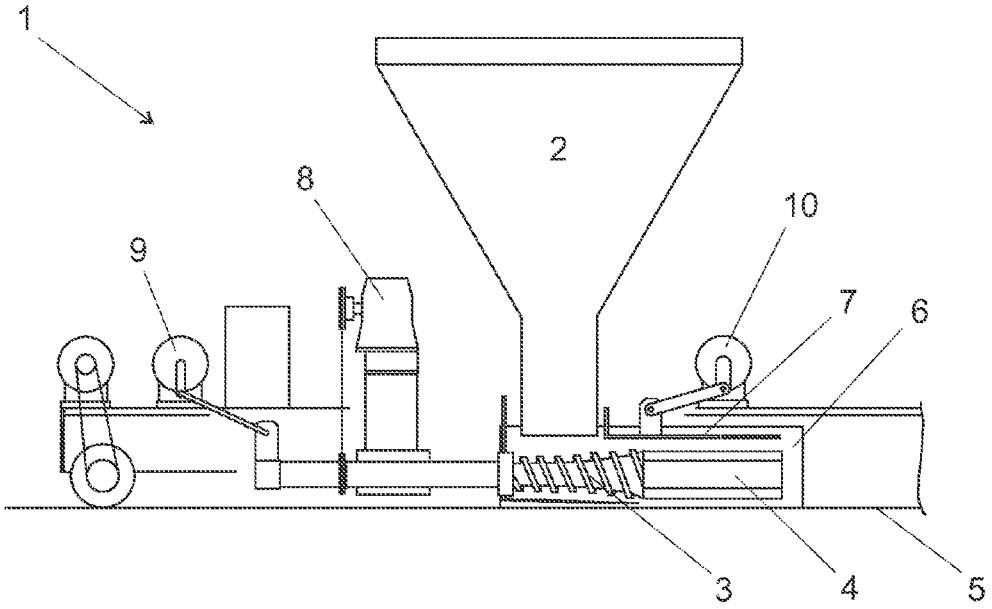
FIG. 1 shows schematically an extruder-type slipform casting apparatus of the invention.

FIG. 1 shows schematically an extruder-type slipform casting apparatus 1, which is operated during slipform casting process by feeding concrete mass from a concrete mass container 2 to feed screws 3, which feed screws extrude the concrete mass in a slipform casting mold formed by a casting bed 5, side plates 6, and a top plate 7. At the downstream end of the feed screws 3 is connected core forming members or mandrels 4, which also restricts the slipfom casting mold and form cores as longitudinal voids in the slab to be cast. The concrete mass is compacted during the slipform casting process by the rotating motion of the feed screws 3 extruding the concrete mass achieved with a drive motor 8, and by back-and-forth movement in the casting direction of the feed screws and the core forming members 4 achieved with a drive motor 9. The outer surfaces of the product to be cast are compacted by back-and-forth movement of the side plates 6, and vibrating and/or throwelling motion of the top plate achieved with a drive motor 10.

Figures 2A, 2B, 2C:
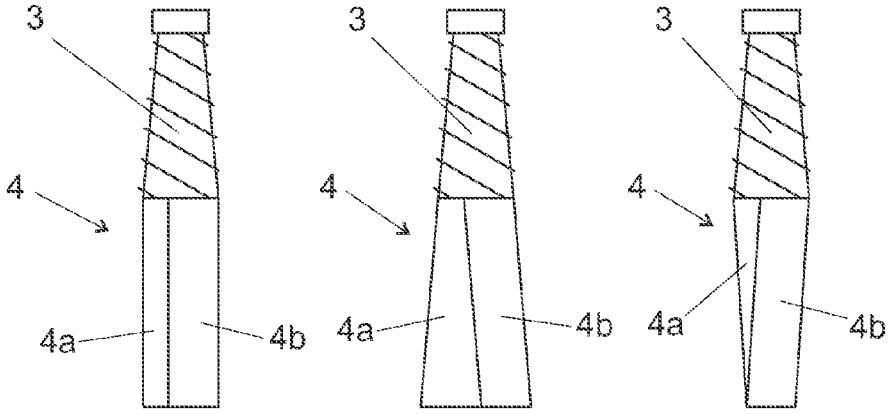
FIGS. 2A-2C show schematically a top view of a core forming member of the invention in different adjustment positions.

FIGS. 2A-2C show schematically the core forming member 4 of the invention attached to the feed screw 3 in different adjustment positions. In the embodiment of FIGS. 2A-2C the core forming member 4 comprises two surface sections 4*a* and 4*b* forming the outer surface of the core forming member, where the surface section 4*a* is located partially inside the surface section 4*b*. Further, the surface sections 4*a* and 4*b* are connected to each other so, that the upstream ends of the surface sections define substantially constant cross-section, but the connection between the surface sections allow the downstream ends of the surface sections to be moved towards and away of each other. This can be achieved with swiveling connection between the surface sections 4*a* and 4*b* at their upstream ends, for example, and allows the core forming member to be fixed securely to the end of the feed screw 3.

In the position of FIG. 2A the hollow core forming member 4 has uniform width through its length, which situation corresponds to the known core forming members.

In the position of FIG. 2B the downstream ends of the surface sections 4*a* and 4*b* of the core forming member 4 are moved in a direction away from each other to provide core forming member that has gradually widening cross-section along its length. Since the downstream end of the core forming member 4 defines the cross-section of the core formed in the product to be cast, the adjustment position of FIG. 2B creates a wider core in the slab to be cast and thus also thinner web between the cores in the slab.

In the position of FIG. 2C the downstream ends of the surface sections 4*a* and 4*b* of the core forming member 4 are moved in a direction towards each other to provide core forming member that has gradually thinning cross-section along its length. This adjustment position creates a thinner core in the slab to be cast and thus also thicker web between the cores in the slab.

Figure 3A:
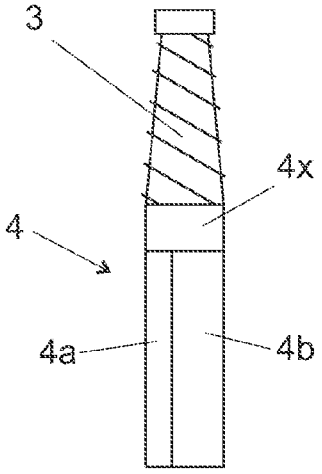
FIGS. 3A-3C show schematically a top view of an alternative core forming member of the invention in different adjustment positions.
Figure 3B:
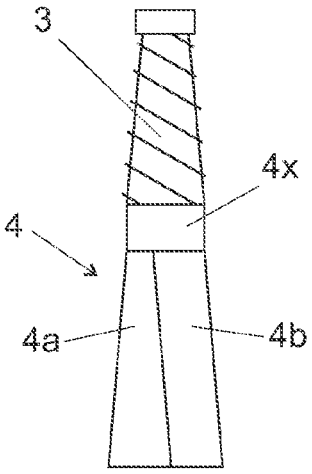
Figure 3C:
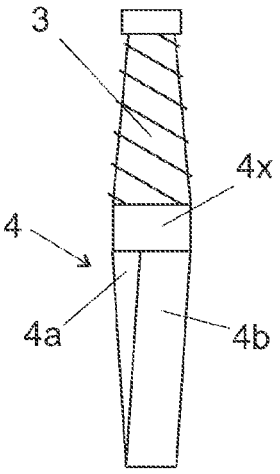

FIGS. 3A-3C show schematically a top view of an alternative core forming member 4 of the invention in different adjustment positions. The core forming member 4 and the positions shown in FIGS. 3A-3C corresponds to FIGS. 2A-2C with the exception that the core forming member comprises section 4*x* at the upstream end of the core forming member. This section 4*x* of the core forming member has substantially uniform unadjustable cross-section through its length, and thus section 4*x* can be used to fix the core forming member 4 at the downstream end of the feed screw 3 easily, that is similarly than connection between the feed screw and any prior art unadjustable core forming member. Further, the section 4*x* also makes the connection between the section 4*x* and the adjustable surface sections 4*a* and 4*b* much easier since the section 4*x* provides unrotating part for fixation and thus facilitates a better starting point for creating an adjustable connection that withstands the pressure of concrete mass inside the slipform casting mold.

Figure 4A:
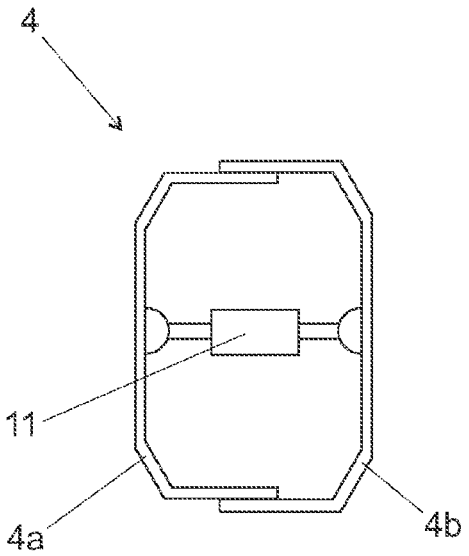
FIGS. 4A and 4B show schematically a back view of different core forming members of the invention.
Figure 4B:
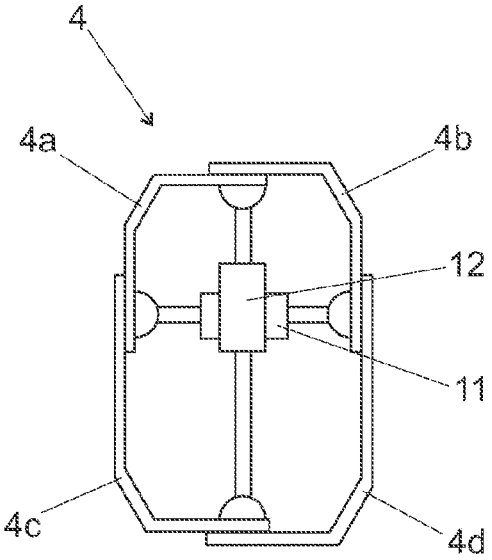

FIGS. 4A and 4B show schematically a back view of different hollow core forming members of the invention.

In the embodiment of FIG. 4A, the core forming part 4 comprises two surface sections 4*a* and 4*b*, where the surface section 4*a* is partially inside the surface section 4*b*. The surface sections 4*a* and 4*b* are connected to each other with suitable swivel connection (not shown) at their upstream ends, and near their downstream ends the surface sections are connected to each other with suitable linear motion device 11, such as a hydraulic or pneumatic cylinder or an electric linear motor, for proving means and power to adjust the position of the downstream ends of the surface sections with respect to each other. The embodiment of FIG. 4A allows adjustment of the width of the downstream end of the core forming member 4.

In the embodiment of FIG. 4B, the core forming part 4 comprises four surface sections 4*a*, 4*b*, 4*c* and 4*d*. In this embodiment the upstream ends of the surface sections 4*a*, 4*b*, 4*c* and 4*d* are connected at the overlapping area to the other overlapping surface section with a suitable swivel connection (not shown). The surface sections 4*a* and 4*b* are connected to each other near their downstream ends with suitable linear motion device 11, which allows the width of the downstream end of the core forming member 4 to be changed. The surface sections 4*c* and 4*d* are connected to other near their downstream ends with another suitable linear motion device 12, which allows the height of the downstream end of the core forming member to be changed.

The specific exemplifying embodiments of the invention shown in figures and discussed above should not be construed as limiting. A person skilled in the art can amend and modify the embodiments of the core forming member of the invention described above, for example, in many evident ways within scope of attached claims. Thus the invention is not limited merely to the embodiments described above.

The invention claimed is:

1. An apparatus for casting a hollow core concrete product with a substantially horizontal slipform casting process, the apparatus comprising a slipform mold defining a limited cross-section for the product to be cast, means for feeding concrete mix through the slipform mold at least in one feeding stage, and at least one core forming member, and means for changing the width of the at least one core forming member during the slipform casting process;

the apparatus further comprising a control system for measuring a casting distance travelled by the apparatus and adapted to change the width of the at least one core forming member at determined points of the slipform casting process.

2. The apparatus according to claim 1, wherein the apparatus further comprises means for changing the height of the core forming member during the slipform casting process.

3. The apparatus according to claim 2, wherein the means for changing the width, or height or both only operates on part of a length of the core forming member.

4. The apparatus according to claim 1, wherein means for feeding concrete mass through the slipform casting mold, comprises a feed screw at the end of which feed screw the core forming member is connected.

5. A core forming member of a slipform casting machine for casting concrete hollow core products, which core forming member comprises at least two surface parts forming the outer surface on the length of the core forming member, and means for changing the distance between the at least two surface parts for changing the width of the core forming member;

the slipform casting machine further comprising a control system for measuring a casting distance travelled by the machine and adapted to change the distance between the at least two surface parts at determined points of the slipform casting process.

6. The core forming member according to claim 5, wherein upstream ends of the at least two surface parts are connected to each other and the means for changing the width of the core forming member are adapted to move only downstream ends of the surface parts.

7. The core forming member according to claim 5, wherein the core forming member comprises at least four surface parts forming an outer surface on the length of the core forming member, and the core forming member comprises means for changing also the height of the core forming member.

* * * * *